United States Patent [19]

Buddy

[11] 4,325,150

[45] Apr. 20, 1982

[54] POOL SURFACE SKIMMING APPARATUS

[76] Inventor: H. E. Buddy, 3311 Bounty Cir., Huntington Beach, Calif. 92649

[21] Appl. No.: 189,680

[22] Filed: Sep. 22, 1980

[51] Int. Cl.[3] ..... E04H 3/20

[52] U.S. Cl. ..... 4/490; 4/496; 137/578; 210/121; 210/169; 210/242.1

[58] Field of Search ..... 4/490, 492, 496, 507, 4/508; 210/169, 242.1, 121; 137/578

[56] References Cited

U.S. PATENT DOCUMENTS

| | | | |
|---|---|---|---|
| 3,443,264 | 5/1969 | Miller | 4/490 |
| 3,579,657 | 5/1971 | Gurrieri | 4/490 |
| 3,616,923 | 11/1971 | Haley | 210/242 |
| 3,633,218 | 1/1972 | Lekberg | 137/578 X |
| 3,633,749 | 1/1972 | Panosh | 210/121 |
| 3,794,446 | 2/1974 | Ost | 210/242.1 X |
| 3,970,556 | 7/1976 | Gore | 210/83 |
| 4,094,338 | 6/1978 | Bauer | 137/578 |
| 4,105,557 | 8/1978 | Weatherholt | 210/169 |
| 4,111,809 | 9/1978 | Pichon | 210/242.1 |
| 4,126,925 | 11/1978 | Jacuzzi | 4/490 X |
| 4,212,740 | 7/1980 | Greene | 210/169 |

*Primary Examiner*—Henry K. Artis
*Attorney, Agent, or Firm*—Lyon & Lyon

[57] ABSTRACT

A pool surface skimming apparatus is disclosed which has two concentric, substantially cylindrical shells engageable one about the other. The inner shell has a floatation means integral therewith and a waste removal basket contained within its lower portion The inner shell floats atop of the surface of the pool thus occasioning collection of solid matter from the pool's miniscus layer. The outer shell provides for the attachment of plumbing fixtures utilizable in the operation of the skimming apparatus.

9 Claims, 3 Drawing Figures

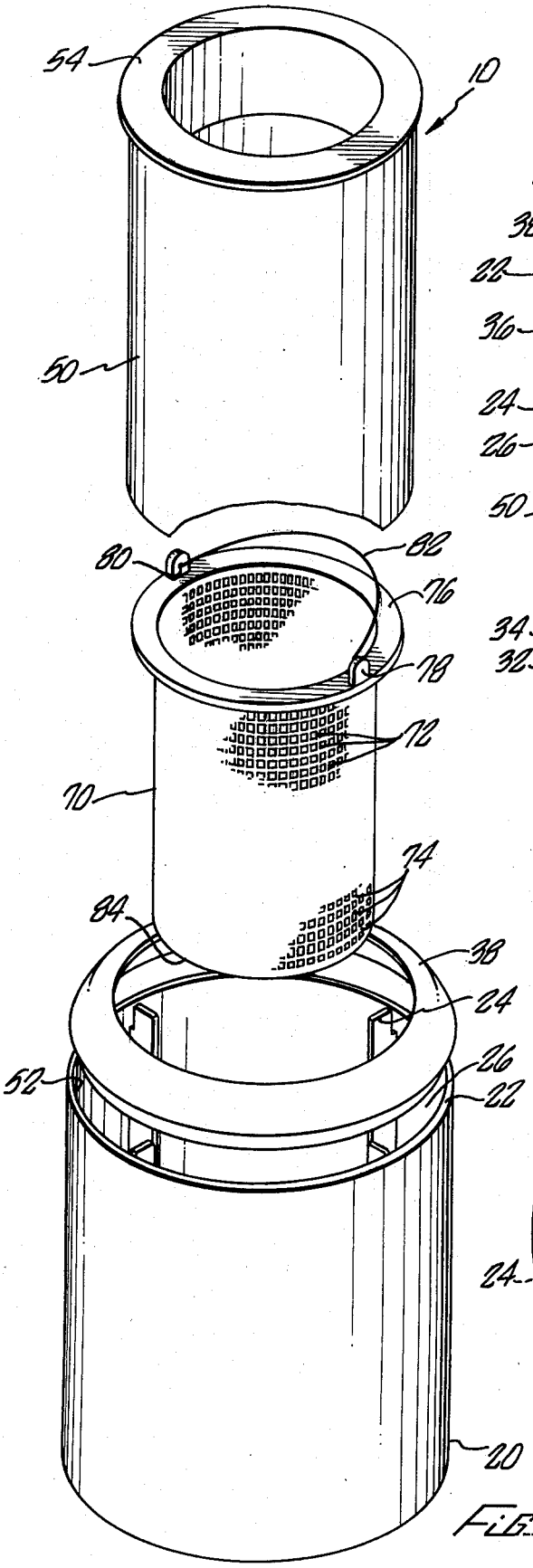
FIG. 1.
FIG. 2.
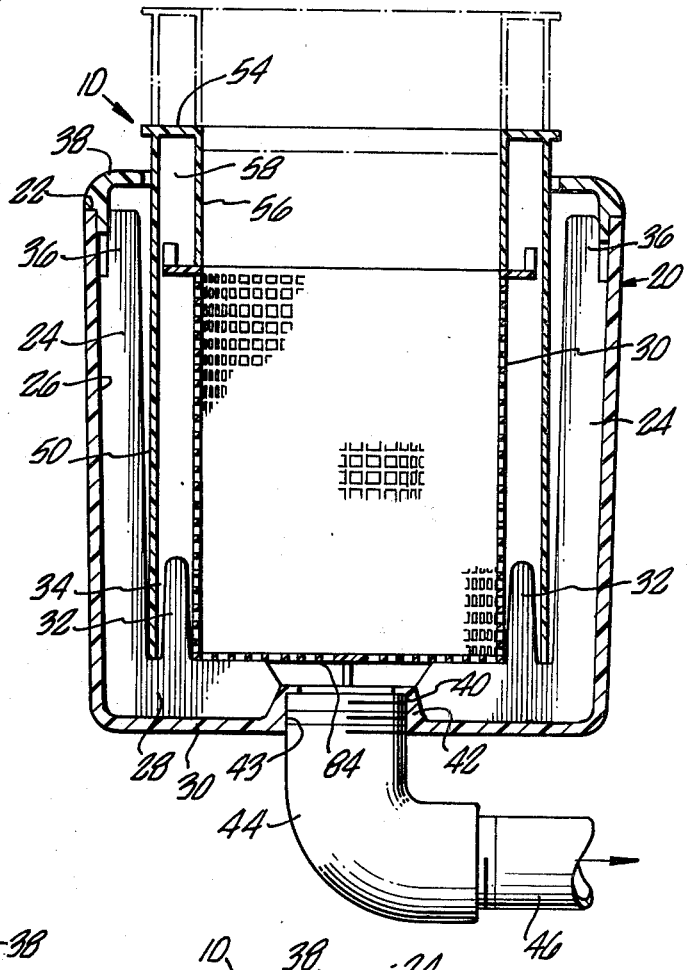
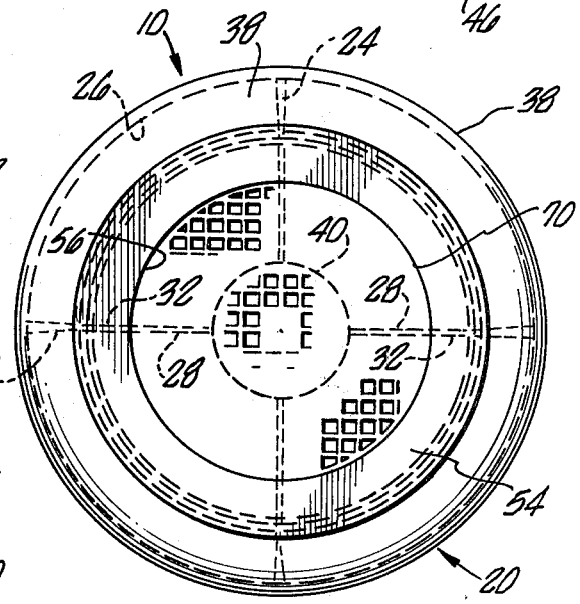
FIG. 3.

POOL SURFACE SKIMMING APPARATUS

BACKGROUND OF THE INVENTION

This invention relates generally to an apparatus for the removal and cleansing of the surface of a body of water or other fluid. It relates particularly to a floating pool skimming apparatus that has a water level reponsive element adapted to ride along the liquid surface to be cleansed and thus occasion removal of accumulated dirt on debris from the upper or miniscus layers of the pool to be cleaned.

With the advent of more economical methods and materials for making and installing recreational swimming pools, or the like, there has been an increased demand for more economical and efficient systems to cleanse the pool surfaces of the organic and inorganic material commonly found thereon. This task has previously been accomplished primarily by suction devices integral with the interior of one of the vertical walls of the swimming pool. This arrangement often requires special fittings and collars to be arranged in relation to the pool surfaces to assure proper sealing and to reduce water loss and limit the possibility of any electrical conduction from suction devices located outside the pool structure. These prior devices were also difficult to maintain and inflexible with regard to their position within the swimming pool. Similarly, changes in the water level resulting from agitation could substantially reduce their effectiveness in removing the dirt accumulated on the surface of the pool to be cleaned.

Attempts were made to provide a skimming device which would float within the pool to be cleansed. These attempts illustrate skimmers attached to submerged surface cleansing devices wherein the skimmer moved about within the pool upon action by multiple jets which controled the horizontal traversal of the skimmer along the water surface and further occasioned agitation of the liquid surface to facilitate the cleansing operation. A water mesh integral with the skimmer assisted in the removal of any accumulated organic material from the pool surface. Other devices illustrated multiple cylinders secured to each other by a flexible membrane. One of its cylinders floated along the pool surface while the other cylinder maintained a position substantially below the level of the pool. Clogging was often found to occur in devices of this nature because of the inability to selectively remove the larger particulate or organic material prior to permitting passage of the smaller matter into the filtering system.

SUMMARY OF THE INVENTION

The invention of the present application is incorporated into a device for the skimming of the fluid surface of a swimming pool. Briefly, the invention includes an outer cylinder which has an aperture in its lower section for facilitating the attachment of a suction hose or the like. The interior of the outer cylinder has multiple vertical rib structures adapted to suspend an inner cylinder and guide the inner cylinder during upward and downward movement occasioned by changes in the water level of the pool to be cleansed.

Integral with the inner cylinder is a flotation collar which is operative to cause a rim extending outwardly from the top of the inner cylinder to float almost flush with the surface of the pool to be cleansed. Suspended by secondary ribs protruding upwardly from the lower portion of the outer cylinder and disposed within the inner cylinder is a skimming basket with a handle or removal means attached thereto.

The suction created by the piping in the lower portion of the outer cylinder will occasion passage of water or fluid over the rim of the inner cylinder and through the skimming basket. Any large matter suspended within the uppermost surfaces of the pool and located in the area about the skimmer of the present invention will be drawn into the basket and retained by the crossed sections integral therewith. At the option of the pool attendant, the inner cylinder may be removed from its location within the outer cylinder and the basket withdrawn for cleaning.

Important to the application of the present invention is a means integral with the outer cylinder for attachment to either a rigid pipe or flexible hose depending upon the use desired by the pool attendant. When attachment is to a rigid pipe, the invention is normally located close to the sidewalls of the pool thereby having a limited effect upon individuals using the pool. When attachment is made to a flexible hose, bouyant elements are secured to the outer cylinder to facilitate its floatation in the pool.

It is therefore an object of the present invention to provide a pool skimming device wherein the device may be either in a fixed or flexible arrangement with regard to the pool surface to be cleaned.

It is another object of the present invention to provide a skimming device having a basket integral therewith for removal of larger matter floating within the pool surface prior to permitting the passage of fluid containing a small or disbursed matter for removal by a filter device.

It is another object of the present invention to provide a skimmer device having a cylinder member responsive to water level changes within the pool and adapted to direct the water to be skimmed through a basket and then into the suction element.

Other objects, advantages and features of the present invention will become apparent from the following detailed description and drawing, wherein:

BRIEF DESCRIPTION OF THE DRAWINGS

FIG. 1 is an exploded view showing the components of the skimmer of the present invention.

FIG. 2 is a side cross-section of the skimmer of the present invention illustrating movement of the inner cylinder.

FIG. 3 is a top elevation of the skimmer of the present invention.

BRIEF DESCRIPTION OF THE PREFERRED EMBODIMENT

A pool surface skimmer apparatus responsive to changes in the level of water in a pool is constructed in accordance with the preferred embodiment of the present invention, shown in FIGS. 1, 2 and 3 and indicated by the numeral 10.

As best illustrated in FIG. 1, the skimmer 10 of the present invention is shown in an exploded configuration. An outer cylinder 20 is open at the top section 22 for entry of the other elements of the skimmer 10. Various forms of cowling may be present atop the outer cylinder 20 as will be described hereinafter. As shown in FIGS. 1 and 2, a multiplicity of ribs 24 extends vertically along the inside wall 26 of the outer cylinder 20 and operate to provide structural support for the outer cylinder 20 so as to prevent lateral deformation during use or in the event of a collision with other objects in the pool.

As best shown in FIG. 2, the ribs 24 extend along the entire inside length of the cylinder 20 and end in base ribs 28 which traverse radially along the floor 30 of the outer cylinder 20. The ribs 28 each have a finger 32 integral therewith and projecting upwardly therefrom parallel with the ribs 24. The number of ribs 24 and fingers 32 associated therewith is variable depending upon the use and environment in which the pool skimmer 10 of the present invention will be used. The fingers 32 and ribs 24 define a slot 34 which is adapted to receive the inner cylinder in its lower most position within the outer cylinder 20. The ribs 24 and inner wall 26 of the outer cylinder 20 define an upper slot 36 which will receive an annular cap 38 or other cowling as mentioned previously. The angular cap 38 operates to restrict movement of fluid into the interior of the outer cylinder 20 without having been passed through the filtering elements of the skimmer apparatus 10. The cap 38 resides between the interior of the outer cylinder 30 and the exterior of the inner cylinder thus effectively sealing the interior portions of the outer cylinder 20.

Within the floor 30 of the outer cylinder 20 is defined an aperture 40. The floor 30 has a raised seat 42 surrounding the aperture 40 which seat 42 further has a threaded section 43 to receive customary plumbing fixtures. In the preferred embodiment the threaded section 43 is adapted to receive customary, 11 pipe. Protruding outwardly from the seat 42 and secured to the outer cylinder 20 by the threaded section 43 is a elbow fitting 44 which has a suction line 46 projecting into the wall (not shown) of the pool or tank in which the skimmer apparatus 10 is to operate. As was discussed previously, the skimmer 10 of the present invention may be attached to a flexible hose for movement throughout the pool or in a rigid manner when used in only one portion of the pool. It should be apparent that other fittings (not shown) may be necessary to connect the flexible hose when used with the skimmer 10. It should also be apparent that floatation devices will be necessary with the outer cylinder 20 to facilitate its use with a flexible hose.

As was discussed previously, the density of dirt particles or other organic material found within a swimming pool or other tank structure is normally greater at the surface of the liquid because of the existing surface tension. Because of this physical condition, to accomplish effective skimming it is only necessary to remove the very top layers of the body of water to efficiently clean the pool. This is most effectively done by permitting a ring structure to cause a waterfall effect to occur thus occasioning the selective removal of only the very top surface layers of the pool.

Referring to FIG. 1, an inner cylinder 50 is disposed within the cavity 52 formed by the outer cylinder 20. The cylinder 50 has an annular ring 54 integral with the top portion thereof and extending outwardly therefrom. The ring 54 also extends inwardly from the cylinder 50 a discreet distance. As illustrated in FIG. 2, the ring 54 has affixed thereto a downwardly extending wall 56 which together with the ring 54 and the outer wall 57 of the inner cylinder 50 define a ballast cavity 58. The cavity 58 is operative to cause the inner cylinder 50 to move in an upper or downward direction in accordance with the water level of the pool or tank within which the skimmer 10 of the present invention is to operate. It should be apparent that although the preferred embodiment illustrates a balast cavity 58 formed from the ring 54, wall 56, and wall 57, other floatation means or ballast collars may be useful to accomplish the same result. In particular, a styrofoam ring or other material having a specific gravity substantially less than (1) one may be useful when affixed to the inner cylinder 50 to occasion movement of the inner cylinder 50 in accordance with the level of the water in the pool to be cleansed.

As best shown in FIGS. 1 and 2, a basket 70 is disposed within the inner cylinder 50 and is supported by the ribs 28. The basket 70 is of a diameter which will fit within the inner cylinder 50 yet permit movement of the inner cylinder 50 in an upward and downward direction within the outer cylinder 20. The basket 70 has multiple vertically extending columns 72 intersected by horizontal ridges 74. Integral with the uppermost portion of each column 72 is an annular ring 76 with has two oppositely positioned pinions 78 extending upwardly therefrom. The pinions 78 have apertures 80 defined therein to provide for the attachment of a wire handle 82 or the like. In the normal position the handle 82 is rotated so as to be flush with the ring 76 and disposed with the cavity 58. The ring 76 extending outwardly and about the basket 70 is disposed just below the inner wall 56 of the inner cylinder 50 thus increasing support for the inner cylinder 50. In the assembled condition the basket 70 fits within the inner cylinder 50 and on the inside of the fingers 32, whereas the inner cylinder 50 fits within the outer cylinder 20 on the outside of the fingers 32. Upon movement of the inner cylinder 50 in an upward direction the basket 70 will continuously remain supported by the ribs 28 in a position slightly above the aperture 40 and seat 42. The cascading effect of the water or other fluid passing over the inner cylinder 50 will exert a force upon the basket 70 thereby causing said basket 70 to remain juxtaposed to said ribs 28.

As best shown in FIGS. 1 and 2, integral with the lower portion of each column 72 is a meshed floor 84 suspended just above the aperture 40, whereby the meshed floor 84 further acts to remove any large matter on the pool surface from entering the filtering system. The top cross-section of the skimmer 10 of the present invention, as shown in FIG. 3, illustrates the concentric orientation of outer cylinder 20, the inner cylinder 50, and the basket 70. Also shown is the position of the aperture 40 and the radially extending ribs 28 and upwardly extending ribs 26.

In operation, the outer cylinder 20 is connected to a section hose 46 which as discussed earlier may be either of a flexible or rigid nature. In the preferred embodiment, the hose 46 is rigid and is attached to a elbow fitting 44 which is secured to the outer cylinder 20 and over the aperture 40 by the threaded section 43. The pipe 46 is connected to a suction element (not shown) which causes passage of any water entering the cavity 52 from the pool surface over the ring 54 and through the basket floor 84.

The flotation of the inner cylinder 50 is controlled by the air pocket formed within the cavity 58. In the operative state, the ring 54 will be approximately flush with the surface of the water contained within the pool structure. It should be apparent that when using various floatation means the inner cylinder 50 may have to be tuned to assure that the ring 54 is substantially flush with the pool surface to be cleaned.

In the course of the operation of the skimmer 10, the body of liquid within the pool surrounding the skimmer 10 can become agitated due to a number of reasons. Continuously, waves are caused within the pool by the movement of individuals when either swimming or simply splashing. As was discussed earlier, the inner cylinder 50 will remain in a position wherein fluid flow will be permitted over the ring 54 despite the presence of waves within the swimming pool. It is in this manner that the desired function of removing the top layers of fluid from the body of the pool to be cleansed is accomplished.

As stated earlier, the presence of the cap 38 prevents fluid from passing into the cavity 52 and then out the aperture 40 without first having the fluid pass through the basket 70 for removal of larger debris or other material to be skimmed from the pool surface. In this manner, whatever debris is found within the miniscus layers of the pool will be collected by the basket 70.

At the discretion of the pool attendant, the inner cylinder 50 may be removed from its seated position atop the ribs 28 and the basket 70 withdrawn for cleaning and dispersal of collected debris. The interior of the basket 70 is smooth to assure easy removal of any accumulated debris.

Although the present skimmer 10 is disclosed as useful with swimming pools or the like, it should be apparent that it is particularly suited for use in other small bodies of fluid, such as lakes, tanks, or aquariums. In instances of this nature, the skimmer 10 is normally rigidly connected to the walls of the tank or aquarium or disposed at the end of a pipe.

The present disclosure includes an extensive discussion of the operation and structure of the present invention. Although this invention has been described in its preferred form to a considerable degree of particularity, it is to be understood that the present disclosure has been made only by way of example and that numerous changes in the details of the construction and arrangement of the parts may be resorted to within departing from the spirit and the scope of the invention.

What is claimed:

1. A pool cleaning apparatus for removing the top layers of water in a swimming pool or the like, the apparatus comprising, a body member, a means for attaching said body member to said swimming pool, a means for creating a suction within said body member, said creating means attached to said body member, a second body member engageable with said body member, said second body member having an upper ring integral therewith, a flotation means, said flotation means integral with said second body element, a filter means disposed within said body member and said second body member whereby fluid passing through said second body member passes through said filter means prior to existing said body member.

2. The apparatus as set forth in claim 1, wherein said body member has multiple ribs integral therewith and disposed on the interior of said body member.

3. The apparatus as set forth in claim 2, which includes a support means for suspending said second body member within said body member.

4. The device as set forth in claim 3 which includes a means for separating said second body member from said filter means.

5. The apparatus of claim 4 wherein said filter means is disposed within said second body element.

6. A pool skimming apparatus for use in removing dirt or other matter from the top layers of a body of water contained within a swimming pool having multiple sidewalls, said skimming apparatus comprising:

a substantially cylindrical outer shell, a means for attaching said cylindrical outer shell to one of said sidewalls of said swimming pool, a means for creating a suction within said cylindrical shell, said creating means affixed to said cylindrical outer shell, rib means integral with said cylindrical outer shell and disposed about the interior surface of said cylindrical outer shell, a substantially cylindrical inner shell disposed within said cylindrical outer shell and adapted to move inward and outward with respect to said outer shell, a float means integral with said cylindrical inner shell, said float means adapted to cause said inner shell to move responsive to the water level in said swimming pool, a filter basket within said inner shell, said filter basket disposed between said floatation means and said creating means.

7. The apparatus as set forth in claim 6, which includes the support means disposed within the bottom of said cylindrical outer shell, said support means adapted to suspend said cylindrical inner shell and said filter basket.

8. The device as set forth in claim 7 which includes a ring means integral with the upper portion of said inner cylindrical shell, said ring means adapted to permit passage of water into said cylindrical outer shell.

9. The apparatus of claim 8 which includes a means for separating said basket element from said cylindrical inner shell, said separating means also adapted to guide said inner shell during movement with respect to said cylindrical outer shell.

* * * * *